US005513498A

United States Patent [19]

Ackermann et al.

[11] Patent Number: 5,513,498

[45] Date of Patent: May 7, 1996

[54] CRYOGENIC COOLING SYSTEM

[75] Inventors: Robert A. Ackermann, Schenectady; Kenneth G. Herd, Niskayuna, both of N.Y.

[73] Assignee: General Electric Company, Schenectady, N.Y.

[21] Appl. No.: 418,229

[22] Filed: Apr. 6, 1995

[51] Int. Cl.[6] ..... F25B 19/00

[52] U.S. Cl. ..... 62/51.1; 62/6

[58] Field of Search ..... 62/6, 51.1

[56] References Cited

U.S. PATENT DOCUMENTS

| | | | |
|---|---|---|---|
| 3,882,687 | 5/1975 | Asztalos | 62/51.1 |
| 4,277,949 | 7/1981 | Longsworth | 62/51.1 |
| 4,432,216 | 2/1984 | Matsuda et al. | 62/51.1 |
| 4,510,771 | 4/1985 | Matsuda et al. | 62/51.1 |
| 5,103,647 | 4/1992 | Ackermann | 62/6 |
| 5,363,077 | 11/1994 | Herd et al. | 62/51.1 |

OTHER PUBLICATIONS

Pending U.S. Patent Application Serial No. 08/288,178, filed Aug. 10, 1994, by K. G. Herd, entitled "Remote Cooling System For A Superconducting Magnet".

"Cryocoolers Part 2: Applications", Graham Walker, Plenum Press, New York, 1983 (pp. 30–41).

"Dynamically Balanced Gifford–McMahon Cold Head", by C. Minas and R. A. Ackermann, Proceedings of the 16th Annual Energy–Sources Technology Conference and Exhibition, ASME, New York, 1993 (pp. 11–16).

*Primary Examiner*—Ronald C. Capossela

*Attorney, Agent, or Firm*—Douglas E. Erickson; Paul R. Webb, II

[57] ABSTRACT

A cryogenic cooling system includes a cryocooler coldhead having a cold stage. A gas circulator has a low pressure input orifice and a high pressure output orifice, and a valve has a primary port and a secondary port. The valve makes and switches fluid connections between the valve's primary and secondary ports and the gas circulator's input and output orifices. A heat exchanger has a primary portion and a secondary portion each in thermal contact with the cold stage. The primary (secondary) regenerator is positioned between the primary (secondary) port of the valve and the primary (secondary) portion of the heat exchanger. A coolant flow path has a first end in fluid communication with the heat exchanger's primary portion and a second end in fluid communication with the heat exchanger's secondary portion. The coolant flow path may be placed in thermal contact with a superconductive device.

10 Claims, 1 Drawing Sheet

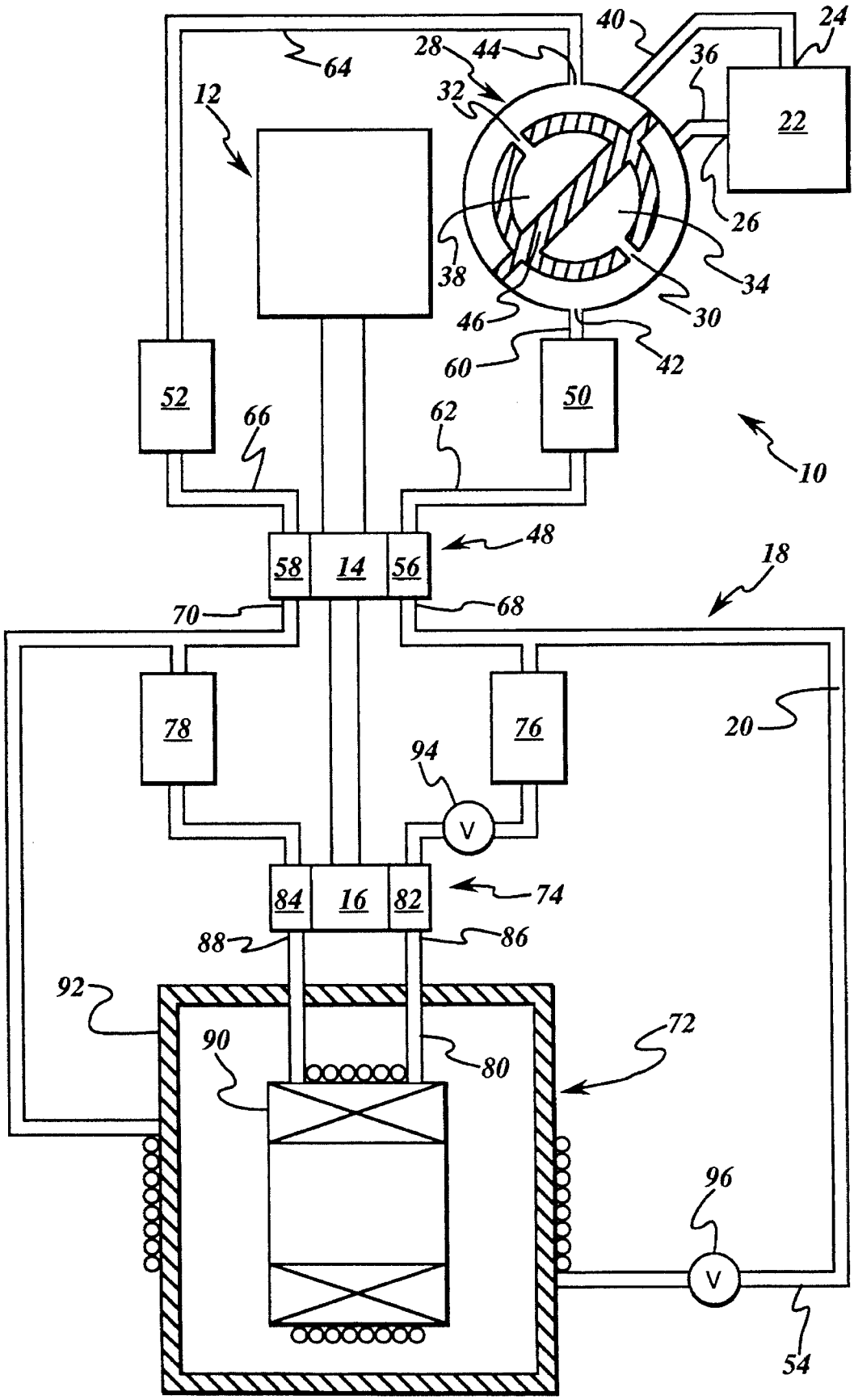
40
24
64
28
44
36
12
32
22
26
38
34
46
30
60
42
52
50
66
62
10
48
58
14
56
18
70
68
78
76
20
94
V
84
16
82
74
88
86
92
72
90
80
96
V
54

CRYOGENIC COOLING SYSTEM

BACKGROUND OF THE INVENTION

The present invention relates generally to refrigeration and more particularly to a cryogenic cooling system useful for cooling, for example, a superconductive device. For purposes of describing the invention, the term "cryogenic" is defined to describe a temperature colder than generally 150 Kelvin.

Superconducting devices include, but are not limited to, magnetic resonance imaging (MRI) systems for medical diagnosis, superconductive rotors for electric generators and motors, and magnetic levitation devices for train transportation. The superconducting coil assembly of a superconducting magnet of a superconductive device includes a vacuum enclosure containing one or more superconductive coils which are wound from superconductive wire and which may be generally surrounded by a thermal shield.

Some superconductive magnets are conductively cooled by a cryocooler coldhead (such as that of a conventional Gifford-McMahon cryocooler) which is mounted to the magnet. Such mounting of the cryocooler coldhead to the magnet creates difficulties including the detrimental effects of stray magnetic fields on the coldhead motor, vibration transmission from the coldhead to the magnet, and temperature gradients along the thermal connections between the coldhead and the magnet. Such conduction cooling is not generally suitable for cooling rotating magnets such as a superconductive rotor.

Other superconductive magnets are cooled by liquid helium in direct contact with the magnet, with such liquid helium boiling off as gaseous helium during magnet cooling and with such gaseous helium typically escaping from the magnet to the atmosphere. Locating the liquid helium containment inside the vacuum enclosure of the magnet increases the size of the magnet system which is undesirable in many superconductive magnet applications.

What is needed is an improved cryogenic cooling system useful for cooling a superconductive device. Further, the cooling system must be remotely located from the magnet. Additionally, the cooling system should be capable of cooling multiple superconductive coil assemblies and should be capable of cooling a rotating superconductive magnet such as that of an electric generator rotor.

SUMMARY OF THE INVENTION

It is an object of the invention to provide a cryogenic cooling system useful for cooling a superconductive device.

The cryogenic cooling system of the invention includes a cryocooler coldhead having a first stage and a coolant circuit containing a gaseous cryogen, such as gaseous helium. The coolant circuit includes a gas circulator, a valve, a first heat exchanger, a first primary regenerator, a first secondary regenerator, and a first coolant flow path. The gas circulator has a low pressure input orifice and a high pressure output orifice. The valve has a high pressure port in fluid communication with the high pressure output orifice of the gas circulator, a low pressure port in fluid communication with the low pressure input orifice of the gas circulator, a primary port, a secondary port, and a mechanism for making and switching fluid connections of the high and low pressure ports each to a corresponding one of the primary and secondary ports. The first heat exchanger has a primary portion and a secondary portion each in thermal contact with the first stage of the cryocooler coldhead. The first primary regenerator is in fluid communication with and is positioned fluidly between the primary port of the valve and the primary portion of the first heat exchanger. The first secondary regenerator is in fluid communication with and is positioned fluidly between the secondary port of the valve and the secondary portion of the first heat exchanger. The first coolant flow path is distinct from the valve, has a first end in fluid communication with the primary portion of the first heat exchanger, and has a second end in fluid communication with the secondary portion of the first heat exchanger.

In an exemplary enablement of the invention, the cryogenic cooling system is for cooling a first superconductive device, wherein the cryocooler coldhead is located outside and is spaced apart from the first superconductive device and wherein the first coolant flow path is in thermal contact with the first superconductive device.

Several benefits and advantages are derived from the invention. Using regenerators in the coolant circuit improves the efficiency of the cryogenic cooling system over using more complex and costly recuperative heat exchangers. Locating the cryocooler coldhead outside and spaced apart from the first superconductive device allows for remote siting of the cooling system away from, for example, a superconductive magnet thus eliminating undesirable vibration and other problems created when a cryocooler coldhead is conventionally mounted to the magnet. Using a gaseous cryogen (such as gaseous helium) in the coolant circuit allows for the cooling of multiple magnets by adding branch paths to the coolant circuit to cool the additional magnets. Furthermore, the coolant circuit may contain a rotatable coupling (e.g., a gaseous-helium transfer coupling including stationary and rotating components) to connect with and cool the superconductive magnet of a rotating superconductive rotor.

BRIEF DESCRIPTION OF THE DRAWING

The accompanying drawing illustrates a preferred embodiment of the present invention wherein:

The FIGURE is a schematic view, partially in section, of a preferred embodiment of the cryogenic cooling system of the invention together with a superconductive device having a superconducting coil and a surrounding thermal shield.

DETAILED DESCRIPTION OF THE INVENTION

Referring now to the drawing, the FIGURE schematically shows the cryogenic cooling system 10 of a preferred embodiment of the present invention. The cryogenic cooling system 10 includes a cryocooler coldhead 12 (such as that of a conventional Gifford-McMahon cryocooler). The cryocooler coldhead 12 has a first stage 14 which may have a temperature, for example, of generally forty Kelvin (which is lower than the previously defined upper "cryogenic" temperature limit of generally 150 Kelvin). A single stage cryocooler coldhead is adequate to cool certain superconductive devices to below their critical temperatures (i.e., the particular temperature at and below which the particular superconductive material behaves superconductively), as can be appreciated by those skilled in the art. Preferably, the cryocooler coldhead 12 also has a second stage 16 which is colder than the first stage 14 and which may have a temperature, for example, of generally ten Kelvin.

The cryogenic cooling system 10 also includes a thermally-insulated coolant circuit 18 containing a gaseous cryogen 20. Preferably, the gaseous cryogen 20 consists essentially of gaseous helium, although other gaseous cryogens may be chosen by the artisan for a particular cryogenic cooling application. The coolant circuit 18 includes a gas circulator 22, such as a conventional compressor, having a low pressure input orifice 24 and a high pressure output orifice 26 wherein the gaseous cryogen 20 has a lower static gas pressure at the low pressure input orifice 24 than it does at the high pressure output orifice 26, such static gas pressures being chosen for a particular cryogenic cooling application, as can be appreciated by those skilled in the art. It is noted that the cryocooler coldhead 12 may be driven by the gas circulator 22 (or by a separate, but not shown, gas circulator) with connections to the coldhead being omitted from the FIGURE for clarity.

The coolant circuit 18 also includes a valve 28 having a high pressure port 30 in fluid communication with the high pressure output orifice 26 of the gas circulator 22 and a low pressure port 32 in fluid communication with the low pressure input orifice 24 of the gas circulator 22, wherein the gaseous cryogen 20 has a lower static gas pressure at the low pressure port 32 than it does at the high pressure port 30. In the preferred embodiment shown in the FIGURE, the high pressure port 30 of the valve 28 is in fluid communication with the high pressure output orifice 26 of the gas circulator 22 via a manifold 34 coupled to a conduit 36, such coupling being omitted from the FIGURE for clarity. Likewise, the low pressure port 32 of the valve 28 is in fluid communication with the low pressure input orifice 24 of the gas circulator 22 via a manifold 38 coupled to a conduit 40, such coupling likewise being omitted from the FIGURE for clarity. The valve 28 also has a primary port 42 and a secondary port 44.

The valve 28 additionally has means for making and switching fluid connections of the high and low pressure ports 30 and 32 each to a corresponding one of the primary and secondary ports 42 and 44. By way of elaboration, during a first time interval, such means fluidly connects the high pressure port 30 to the primary port 42 and fluidly connects the low pressure port 32 to the secondary port 44. At the end of the first time interval, such means breaks such fluid connections. During a second time interval which generally immediately follows the end of the first time interval, such means fluidly connects the high pressure port 30 to the secondary port 44 and fluidly connects the low pressure port 32 to the primary port 42. At the end of the second time interval, such means breaks such fluid connections. The above sequence of making and switching of fluid connections is repeated for successive time intervals during operation of the cryogenic cooling system 10. Preferably, the valve 28 is a rotary valve and such means includes a rotatable rotor 46 which is driven by a motor (omitted from the FIGURE for clarity) to continuously turn in one rotational direction during operation of the cryogenic cooling system 10 and which is configured such that manifold 34 with its associated high pressure port 30 and manifold 38 with its associated low pressure port 32 rotates past the circumferentially surrounding primary and secondary ports 42 and 44, as can be appreciated by those skilled in the art. As can be appreciated by the artisan, the previously described coupling of conduit 36 to its associated manifold 34 and of conduit 40 to its associated manifold 38 is a rotary coupling when the valve 28 is a rotary valve. Alternately, the valve can be a linearly reciprocating valve (e.g., a spool valve) wherein such means would be a linearly reciprocating member having channels configured to accomplish the required making and switching of fluid connections, as can be understood by the artisan. Additional such means includes other switching valves, as is known to those skilled in the art.

The coolant circuit 18 additionally includes a first heat exchanger 48, a first primary regenerator 50, a first secondary regenerator 52, and a first coolant flow path 54. The first heat exchanger 48 has a primary portion 56 and a secondary portion 58 each in thermal contact with the first stage 14 of the cryocooler coldhead 12. The first primary regenerator 50 is in fluid communication with and disposed fluidly between the primary port 42 of the valve 28 and the primary portion 56 of the first heat exchanger 48. Likewise, the first secondary regenerator 52 is in fluid communication with and disposed fluidly between the secondary port 44 of the valve 28 and the secondary portion 58 of the first heat exchanger 48. Such fluid communications are accomplished by conduits 60, 62, 64, and 66. The first coolant flow path 54 is distinct from the valve 28 (i.e., the first coolant flow path 54 does not pass through the valve 28), has a first end 68 in fluid communication with the primary portion 56 of the first heat exchanger 48, and has a second end 70 in fluid communication with the secondary portion 58 of the first heat exchanger 48.

Preferably, the cryogenic cooling system 10 is for cooling a first superconductive device 72 such as, but not limited to, magnetic resonance imaging (MRI) systems for medical diagnosis, superconductive rotors for electric generators and motors, and magnetic levitation devices for train transportation. In this employment of the cryogenic cooling system 10 of the invention, the first coolant flow path 54 is in thermal contact with the first superconductive device 72. It is preferred that the cryocooler coldhead 12 is disposed outside and is spaced apart from the first superconductive device 72. In an exemplary embodiment, the cryocooler coldhead 12 would be sited remotely from the first superconductive device 72. For particular applications (not shown in the FIGURE), the first coolant flow path has additional branches to cool additional superconductive devices all from a single cryocooler coldhead.

In a preferred embodiment, the coolant circuit 18 further includes a second heat exchanger 74, a second primary regenerator 76, a second secondary regenerator 78, and a second coolant flow path 80. The second heat exchanger 74 has a primary portion 82 and a secondary portion 84 each in thermal contact with the second stage 16 of the cryocooler coldhead 12. The second primary regenerator 76 is in fluid communication with and disposed fluidly between the primary portion 56 of the first heat exchanger 48 and the primary portion 82 of the second heat exchanger 74. Likewise, the second secondary regenerator 78 is in fluid communication with and disposed fluidly between the secondary portion 58 of the first heat exchanger 48 and the secondary portion 84 of the second heat exchanger 74. Such fluid communications are accomplished by conduits (whose part numbers have been omitted from the FIGURE for clarity). The second coolant flow path 80 is distinct from the valve 28 and the first coolant flow path 54 (i.e., the second coolant flow path 80 does not pass through the valve 28 or the first coolant flow path 54), has a first end 86 in fluid communication with the primary portion 82 of the second heat exchanger 74, and has a second end 88 in fluid communication with the secondary portion 84 of the second heat exchanger 74.

Preferably, in the employment of the cryogenic cooling system 10 of the invention to cool the first superconductive device 72, the second coolant flow path 80 also is in thermal contact with the first superconductive device 72. In an exemplary embodiment, the first superconductive device 72 includes a superconducting coil 90 wound from superconducting wire or tape and also includes a thermal shield 92 generally surrounding the superconducting coil 90. In this construction, the second coolant flow path 80 is in thermal contact with the superconducting coil 90 (by having, for example, a portion of the second coolant flow path 80 coiled around, and in physical contact with, the superconducting coil 90 as shown in the FIGURE), and the first coolant flow path 54 is in thermal contact with the thermal shield 92 (by having a portion of the first coolant flow path 54 coiled around, and in physical contact with, the thermal shield 92 as shown in the FIGURE). It is noted that the first superconductive device 72 further includes a surrounding vacuum enclosure which has been omitted from the FIGURE for clarity. The coolant circuit 18 moreover includes two metering valves 94 and 96 (or sized orifices), as shown in the FIGURE, to achieve desired gaseous helium mass flow rates, as can be appreciated by those skilled in the art.

By way of example, preferably the superconducting coil 90 is wound from a Nb—Sn superconducting tape having a critical temperature (which depends on current and field) of generally twelve Kelvin for superconductivity, the first stage 14 of the cryocooler coldhead 12 has a temperature of generally forty Kelvin, and the second stage 16 of the cryocooler coldhead 12 has a temperature of generally ten Kelvin. Preferably, the first primary and first secondary regenerators 50 and 52 contain bronze or copper wire screens, and the second primary and second secondary regenerators 76 and 78 contain lead spheres.

In operation, during one-half of a revolution of the rotatable rotor 46 of the valve 28, the high pressure port 30 of the valve 28 is in fluid communication with the primary port 42 of the valve 28 (and the low pressure port 32 is in fluid communication with the secondary port 44), as shown in the FIGURE, moving the gaseous cryogen 20 through the coolant circuit 18 in a generally clockwise direction when viewing the FIGURE. During the other-half of a revolution of the rotatable rotor 46, the high pressure port 30 is in fluid communication with the secondary port 44 (and the low pressure port 32 is in fluid communication with the primary port 42) moving the gaseous cryogen 20 through the coolant circuit 18 in the opposite (i.e., counterclockwise) direction. Thus, for one-half of a revolution of the rotatable rotor 46, gaseous cryogen 20 flows in one direction through a regenerator 50, 52, 76, or 78, and for the other-half of a revolution, gaseous cryogen 20 flows in the opposite direction through the same regenerator 50, 52, 76, or 78. With properly chosen static pressures at the high pressure output and low pressure input orifices 26 and 24 of the gas circulator 22, and with a properly chosen rotational speed for the rotatable rotor 46, gaseous cryogen 20 will circulate at least once completely around the coolant circuit 18 before reversing direction to achieve proper cooling, as can be appreciated by the artisan. When colder gaseous cryogen 20 moves in one direction through a regenerator 50, 52, 76, or 78, the regenerating material therein (e.g., the bronze or copper wire screens or the lead spheres) will give up some of its heat making the gaseous cryogen 20 warmer and the regenerating material colder. When such warmer gaseous cryogen 20 moves in the opposite direction through the same regenerator 50, 52, 76, or 78, the warmer gaseous cryogen 20 will give up some of its heat making the gaseous cryogen 20 colder and the regenerating material warmer. Such regenerators and their operation are known in the art.

Engineering analysis has shown that use of such regenerators 50, 52, 76, and 78 in the coolant circuit 18 of the cryogenic cooling system 10 of the present invention achieves an efficiency of greater than 99% compared to efficiencies of only 96% when recuperative heat exchangers are used in a cryogenic cooling design. Moreover, regenerators are simple in design and low in cost compared to the large recuperative heat exchangers otherwise needed. It is noted that the periodic nature of a regenerator with the flow periodically reversing direction eliminates the need for seals and flow headers to separate and channel the flow streams.

As can be appreciated by those skilled in the art, in the event of cryocooler malfunction, the helium (or other cryogen) gas flow can be stopped which will essentially thermally isolate the superconducting coil 90. The pressurized helium gas in the coolant circuit 18, and especially in the second coolant flow path 80, acts as a thermal buffer which allows time to replace the cryocooler before the superconducting coil 90 quenches (i.e., loses its superconductivity). A single-stage cryocooler coldhead typically would be all that is required to reach the relatively high critical temperatures of hoped-for future superconductive materials that would someday comprise the superconducting tape or wire of the superconducting coil 90. For example, for a future superconducting wire having a critical temperature of generally forty-two Kelvin or higher for superconductivity, the cold stage of the single-stage cryocooler coldhead would be maintained at a temperature of generally forty Kelvin. It is noted that a thermal shield would no longer be required for such a superconductive device.

The foregoing description of several preferred embodiments of the invention has been presented for purposes of illustration. It is not intended to be exhaustive or to limit the invention to the precise form disclosed, and obviously many modifications and variations are possible in light of the above teaching. For example, the cryogenic cooling system 10 of the invention can be extended to multiple cryocooler coldheads and/or to a cryocooler coldhead having three or more stages. It is noted that the terminology "thermal contact" includes direct and indirect gas, liquid, and/or solid thermal contact, and that the terms "primary" and "secondary" do not denote degree of importance but were chosen to differentiate and describe certain components. It is intended that the scope of the invention be defined by the claims appended hereto.

We claim:

1. A cryogenic cooling system comprising:

a) a cryocooler coldhead having a first stage; and b) a coolant circuit containing a gaseous cryogen and including:

1) a gas circulator having a low pressure input orifice and a high pressure output orifice;

2) a valve having:

(a) a high pressure port in fluid communication with said high pressure output orifice of said gas circulator;

(b) a low pressure port in fluid communication with said low pressure input orifice of said gas circulator;

(c) a primary port;

(d) a secondary port; and (e) means for making and switching fluid connections of said high and low pressure ports each to a corresponding one of said primary and secondary ports;

3) a first heat exchanger having a primary portion and a secondary portion each in thermal contact with said first stage of said cryocooler coldhead;

4) a first primary regenerator in fluid communication with and disposed fluidly between said primary port of said valve and said primary portion of said first heat exchanger;

5) a first secondary regenerator in fluid communication with and disposed fluidly between said secondary port of said valve and said secondary portion of said first heat exchanger; and 6) a first coolant flow path distinct from said valve, having a first end in fluid communication with said primary portion of said first heat exchanger, and having a second end in fluid communication with said secondary portion of said first heat exchanger.

2. The cryogenic cooling system of claim 1, wherein said means includes a rotatable rotor.

3. The cryogenic cooling system of claim 1 for cooling a first superconductive device, wherein said cryocooler coldhead is disposed outside and spaced apart from said first superconductive device and wherein said first coolant flow path is in thermal contact with said first superconductive device.

4. The cryogenic cooling system of claim 1, wherein said cryocooler coldhead also has a second stage colder than said first stage, and wherein said coolant circuit also includes:

7) a second heat exchanger having a primary portion and a secondary portion each in thermal contact with said second stage of said cryocooler coldhead;

8) a second primary regenerator in fluid communication with and disposed fluidly between said primary portion of said first heat exchanger and said primary portion of said second heat exchanger;

9) a second secondary regenerator in fluid communication with and disposed fluidly between said secondary portion of said first heat exchanger and said secondary portion of said second heat exchanger; and 10) a second coolant flow path distinct from said valve and said first coolant flow path, having a first end in fluid communication with said primary portion of said second heat exchanger, and having a second end in fluid communication with said secondary portion of said second heat exchanger.

5. The cryogenic cooling system of claim 4, wherein said means includes a rotatable rotor.

6. The cryogenic cooling system of claim 4 for cooling a first superconductive device, wherein said cryocooler coldhead is disposed outside and spaced apart from said first superconductive device and wherein said second coolant flow path is in thermal contact with said first superconductive device.

7. The cryogenic cooling system of claim 6, wherein said first superconductive device includes a superconducting coil and wherein said second coolant flow path is in thermal contact with said superconducting coil.

8. The cryogenic cooling system of claim 7, wherein said first coolant flow path is in thermal contact with said first superconductive device.

9. The cryogenic cooling system of claim 8, wherein said first superconductive device also includes a thermal shield generally surrounding said superconducting coil and wherein said first coolant flow path is in thermal contact with said thermal shield.

10. The cryogenic cooling system of claim 9, wherein said gaseous cryogen consists essentially of gaseous helium.

* * * * *